US006751805B1

(12) United States Patent
Austion

(10) Patent No.: US 6,751,805 B1
(45) Date of Patent: Jun. 22, 2004

(54) RIDER DOWN EMERGENCY IDENTIFICATION CARD

(76) Inventor: Kenneth Austion, 675 Belmont Rd., Clarksville, TN (US) 37040

( * ) Notice: Subject to any disclaimer, the term of this patent is extended or adjusted under 35 U.S.C. 154(b) by 113 days.

(21) Appl. No.: 10/173,022

(22) Filed: Jun. 17, 2002

(51) Int. Cl.[7] ..... A41D 3/02
(52) U.S. Cl. ..... 2/94
(58) Field of Search ..... 2/94, 456, 69, 2/69.5, 79, 227, 93, 102, 108, 115, 195.1, 159, 247–253, 912; 40/1.5

(56) References Cited

U.S. PATENT DOCUMENTS 3,438,062 A * 4/1969 Curzon ..... 2/247
4,202,053 A * 5/1980 Bell ..... 2/84
4,651,355 A * 3/1987 White ..... 2/247
4,710,981 A * 12/1987 Sanchez ..... 2/115
4,924,613 A * 5/1990 Levin ..... 40/586
4,969,214 A * 11/1990 Cohen ..... 2/94
5,452,479 A * 9/1995 Mostert ..... 2/195.1
5,884,338 A * 3/1999 Golde ..... 2/247

* cited by examiner

*Primary Examiner*—Tejash Patel
(74) *Attorney, Agent, or Firm*—Michael I Krull

(57) ABSTRACT

An emergency identification card acting as a means for storage of vital medical information pertaining to a user wearing said card. The emergency identification card would be contained on a user or on a user vehicle or both. The emergency identification card may have a quick disconnect cover. Medical information would be readable by an emergency medical technician at a scene of an accident. Emergency identification card could also contain information in scannable format that would be read into a scanner, transferred to a central location whereby central location could send back more information pertinent to treatment of person in accident or other medical situation. Database at central location could be updated by user or by user physician.

3 Claims, 12 Drawing Sheets

RIDER DOWN EMERGENCY IDENTIFICATION CARD

BACKGROUND OF THE INVENTION

1. Field of the Invention

The present invention relates generally to printed documents and, more specifically, to an emergency identification card having user specified information that can be used by emergency personnel to aid the bearer of said card in the case where the bearer of the card is involved in an accident. The emergency identification card can be displayed on a garment sleeve, belt or headwear and can include a quickly detachable cover.

Normal documents carried by a person in a wallet or purse do not contain information that is essential in administering aid to accident victims. This is especially hazardous to users of high-risk conveyances such as motorcycles, bicycles, 4-wheel All Terrain Vehicles, snowmobiles, etc. where the victim has a higher potential of being disoriented or unconscious after an accident.

Additionally motorcycle, bicycle, 4-Wheel All Terrain Vehicle, etc. owners use their cycles more as a sport to travel the open or back roads than automobile owners traveling from point "A" to point "B". Therefore motorcyclists, bicyclists, 4-Wheel All Terrain Vehicle owners, snowmobile owners, etc. have a tendency to spend more time driving and are more likely to be traveling great distances to join other riders for open air events which places them in a high risk category.

Furthermore the probability of being unconscious as a result of an accident increases with speed and terrain. Considering these things it becomes apparent that the aforementioned riders should carry some information that would help emergency personnel in administering aid to the accident victim and notifying loved ones as to the condition of the accident victim. This becomes especially important if there is a medical condition that must be considered in any medical treatment.

Therefore it is felt that a need exists for an emergency identification card that can be filled out by the bearer, or a third party, having identification of the bearer, contact information and medical information that can be used to aid the bearer in the event of an accident. The card may be manufactured of a PVC type plastic similar to a credit card with a means for electronically storing and retrieving data thereby allowing emergency service workers access to more detailed information than may be provided in the text on the card. The data may be stored on the card itself using bar codes or other such means or may be stored in a database with the card having a pin number that, when scanned, will access the database and all pertinent information entered therein. The user's physician can update any changes regarding the patient's needs. Not only can the database provide information about the user's physician such as telephone numbers and the like, but the physician may update the database when not available to provide the phone number for the physician on call for his cases so that medical information and contacts may always be up to date and readily available. The card should be placed in the users wallet so that it is the first visible ID when opened.

Additionally, the card (or copies thereof) can be externally attachable to clothing and/or equipment to be easily viewable to emergency personnel in providing the transfer of relevant information to emergency personnel especially medical information.

2. Description of the Prior Art

There are other identification devices designed for storing personal information. Typical of these is U.S. Pat. No. 601,869 issued to Busch on Apr. 5, 1898.

Another patent was issued to Dorf on Sep. 16, 1924 as U.S. Pat. No. 1,508,963. Yet another U.S. Pat. No. 2,666,655 was issued to Wolowitz on Jan. 19, 1954 and still yet another was issued on Dec. 7, 1965 to Fischler et al. as U.S. Pat. No. 3,221,428.

Another patent was issued to Wittboldt on Jan. 16, 1968 as U.S. Pat. No. 3,363,346. Yet another U.S. Pat. No. 3,958,690 was issued to Gee, Sr. on May 25, 1976. Another was issued to Davidson et al. on May 29, 1979 as U.S. Pat. No. 4,156,539 and still yet another was issued on Feb. 6, 1990 to Kass-Pious as U.S. Pat. No. 4,897,947.

Another patent was issued to Dusek on Dec. 15, 1992 as U.S. Pat. No. 5,171,039. Yet another U.S. Pat. No. 5,195,783 was issued to Lavoie on Mar. 23, 1993. Another was issued to MacDonald on Sep. 6, 1994 as U.S. Pat. No. 5,343,608 and still yet another was issued on Jan. 10, 1995 to Stephens as U.S. Pat. No. 5,380,046.

U.S. Pat. No. 601,869

Inventor: George W. Busch

Issued: Apr. 5, 1898

The invention is designed to identify in case of an accident the person wearing the tablet; and the object of the invention is to make the tablet indestructible by the usual agencies, such as fire and water, and to make it of such a convenient form that it can be readily carried on a string around the neck or in any other desired way in which personal ornaments, lockets, chains, or other like trinkets are worn, while at the same time the information which it contains is safely locked up and readily accessible in case of emergency.

U.S. Pat. No. 1,508,963

Inventor: Hernan Dorf

Issued: Sep. 16, 1924

The invention is a belt buckle having a vanity compartment with a hinged door wherein articles of jewelry, money or the like may be carried with comparative safety to the wearer. The compartment has an interior hinged door in the back wall for inserting a suitable identification card or picture therein.

U.S. Pat. No. 2,666,655

Inventor: William H. Wolowitz

Issued: Jan. 19, 1954

The invention is a protective case for documents provided with data or information while sealed within such protective case or shield. The case or shield has a removable reproducing means by which a signature or other writing or marking may be inscribed on the data surface sealed within the case, and said reproducing means thereafter removed so that the completed card or document is sealed within the case and protected against any change or alteration in the signature or other inscription thereon.

U.S. Pat. No. 3,221,428

Inventor: Wanda B. Fischler et al.

Issued: Dec. 7, 1965

The invention is a sealed document assembly adapted to indicate tampering therewith comprising a document with visible indicia thereon; an encasement of transparent synthetic plastic material extending about said document; and chemical reagent means within said encasement substantially inert to said document during sealed assembly and reactive upon rupturing of said encasement to evidence tampering.

U.S. Pat. No. 3,363,346

Inventor: Sven V. Wittboldt

Issued: Jan. 16, 1968

The invention is a data card for compiling, transporting and communicating data comprising a first substantially rectangular sheet of paper and two larger sheets of plastic material disposed on opposite sides of said paper and sealed together about the edges thereof, said card being divided up into a plurality of data fields identifiable by X-Y coordinates, said plastic material being of the type suitable for embossing whereby one of said data fields may be provided with embossed data capable of being reproduced, said plastic material having dye means impregnated therein so that said embossed data is disposed in light-dark contrast with the remainder of said care, said plastic being normally X-ray opaque and capable of being selectively modified in another one of said data fields whereby information contained in said data field may be reproduced by means of X-rays.

U.S. Pat. No. 3,958,690

Inventor: Robert W. Gee, Sr.

Issued: May 25, 1976

A medical identification, information and emergency medication packet adapted for wearing or carrying by a patient, said packet comprising an envelope, preferably transparent; a foldable information card slidably insertable in said envelope; and a frame comprehended within the card when so folded, said frame with the inside of the folded card defining at least one space within which is housed a dosage quantity of a medication to be administered to the patient in an emergency in accordance with the instructions printed on said card.

U.S. Pat. No. 4,156,539

Inventor: Maxine J. Davidson et al.

Issued: May 29, 1979

An identification card is provided with use by athletes and sportsmen, particularly younger athletes and sportsmen and which includes identification of the user and perforated sections for selective removal from the card. Each section indicates a medical problem such as a Diabetic, Allergy, Internal Mouthpiece and the like. The card and the removable sections are provided with pressure sensitive adhesive on the back thereof initially covered with a removable paper shield. In use, the user fills out his name and address, etc. and then, in one embodiment, removes and discards the perforated sections not applicable to him, removes the paper shield and adhesively secures the remaining portion of the card to his clothing at the shoulder or other convenient location. In another embodiment, certain perforated sections can be removed and discarded or, if required, adhesively secured to the clothing above the identification portion to indicate his disabilities. In both embodiments, the medical condition or disability is indicated to other personnel if by chance, he is unable to communicate due to accident, disability or the like.

U.S. Pat. No. 4,897,947

Inventor: Stephanie Kass-Pious

Issued: Feb. 6, 1990

An identification member adapted to be secured to shoes having laces or straps includes an integrally formed carrier of synthetic resin having a base and a cover which are hingedly connected along one side margin thereof The base provides a cavity in which is seated an identification element, and the cover and base have interfitting side walls which engage in the closed position. Depending from the bottom wall of the base is a U-shaped engagement loop through which a shoelace or strap passes to secure the carrier to the top of the shoe.

U.S. Pat. No. 5,171,039

Inventor: Michael E. Dusek

Issued: Dec. 15, 1992

A wallet size laminated medical information card is made by providing the information on a form at a physician's center. The information is then transmitted to a data base where it is reproduced on format software which adjusts the size of the information for wallet size. The information is then laser printed onto a card which is plastic laminated and folded so that it is of conventional credit card size, while the information thereon can be read without the use of special optical devices.

U.S. Pat. No. 5,195,783

Inventor: Matthew J. Lavoie

Issued: Mar. 23, 1993

This disclosure relates to the field of identification devices. Embodiments include a shoelace, near the center of which is affixed a flexible strip, made from textile, plastic, or other suitable material, that is adapted to be wrapped about the shoelace and retained in that position. Desired information, such as name, address, telephone number, blood type, medical facts of special concern, or the like, may appear on the surface of the strip which is to be concealed by the strip having been overlaid by itself as it is wrapped about the shoelace. The strip, so marked and so positioned, may be surrounded by a protective cover material, such as a short, tubular segment of clear plastic, to protect the strip while keeping the distinguishing indicia visible. Such protective cover and/or the surface of the strip which is exposed when the strip is so wrapped may include distinguishing indicia to notify interested persons, such as police, medical workers, etc., of the existence of the enclosed information. Thereby, the identification of a lost child, or information relevant to treating a person in medical emergency may be identified as being available and made easily accessible when needed, while being concealed until then.

U.S. Pat. No. 5,343,608

Inventor: Robert D. MacDonald

Issued: Sep. 6, 1994

A method of forming an identification band from a tube with a constant circular cross-section along the majority of its outer circumference. The tube holds an indicia, and the information on the indicia is magnified by the generally circular shape of the tube. The circular shape also minimizes contact between the band and the wearer. Contact is limited to line contact with the skin, and irritation of the skin is reduced by eliminating any edges which may cut or scrape the skin. A method of forming the identification band includes the steps cutting a predetermined length of tube, placing an indicia therein, and completing the assembly by inserting an untapered cylindrical plug into each end of the tube.

U.S. Pat. No. 5,380,046

Inventor: Gregory W. Stephens

Issued: Jan. 10, 1995

A personal information packet to be carried by a child or other person to provide identification and relevant information to authorities in the event of an emergency comprises a folded information card bearing personal information on the shielded inwardly folded side of the card sealed within a transparent plastic envelope to secure the card against outward view of the personal information and against unauthorized removal of the card without breaching the sealed integrity of the envelope. A notice is printed on the outward side of the card to alert authorities that personal information is contained within the packet and a broken line shows authorities where to cut open the packet without obliterating the information.

While these identification devices may be suitable for the purposes for which they were designed, they would not be as suitable for the purposes of the present invention, as hereinafter described.

SUMMARY OF THE PRESENT INVENTION

A primary object of the present invention is to provide a small, durable, weather resistant, document that can be carried on a person and containing contact and medical information that could be used in case of an accident to aid the bearer of said document.

Another object of the present invention is to provide an emergency identification card that can be carried by motorcyclists, bicyclists, 4-wheel All Terrain Vehicle owners, snowmobile owners, etc. to aid emergency personnel in administering aid to the bearer involved in an accident.

Yet another object of the present invention is to provide an emergency identification card having contact information that can be used by emergency personnel to aid the bearer involved in an accident.

Still yet another object of the present invention is to provide an emergency identification card having medical information that can be used by emergency personnel to aid the bearer involved in an accident.

Another object of the present invention is to provide an identification card that can be carried unobtrusively.

Yet another object of the present invention is to provide an identification card having user entered information that can be used to aid the bearer of the card in case of accident.

Still another object of the present Invention is to provide an identification card having a means for electronically storing and retrieving detailed pertinent data.

Still yet another object of the present invention is to provide an identification card having a space provided for entering the name and address of the bearer of the identification card.

Another object of the present invention is to provide an identification card having a space provided for entering emergency contact information for the bearer of the identification card.

Yet another object of the present invention is to provide an identification card having a space provided for entering medical information for the bearer of the identification card.

Still yet another object of the present invention is to provide an identification card that is readily accessible to police and emergency medical personnel to aid an accident victim.

Another object of the present invention is to provide an emergency identification card having a weather resistant protective envelope.

Yet another object of the present invention is to provide an emergency identification card having indicia to aid emergency personnel in locating the emergency identification card.

Still yet another object of the present invention is to provide an emergency identification card that can be attached to clothing and/or equipment worn by an a user for use by emergency personnel in case of an accident.

Another object of the present invention is to provide means for attaching the emergency identification card to the clothing and or equipment of the bearer of said card.

Yet another object of the present invention is to provide an emergency identification card that can be attached to a protective helmet.

Still yet another object of the present invention is to provide an emergency identification card that can be attached to protective headgear used by motorcyclists, bicyclists, 4-wheel All Terrain Vehicle owners, snowmobile owners, etc.

Still another object of the present invention is to provide for a quickly detachable cover for the emergency identification card. Such cover can contain an insignia.

Additional objects of the present invention will appear as the description proceeds.

The present invention overcomes the shortcomings of the prior art by providing an emergency identification card having user specified information that can be used by emergency personnel to aid the bearer of said card when involved in an accident. The identification card can also provide an electronic means for storing and retrieving data on the card or from a remote location.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
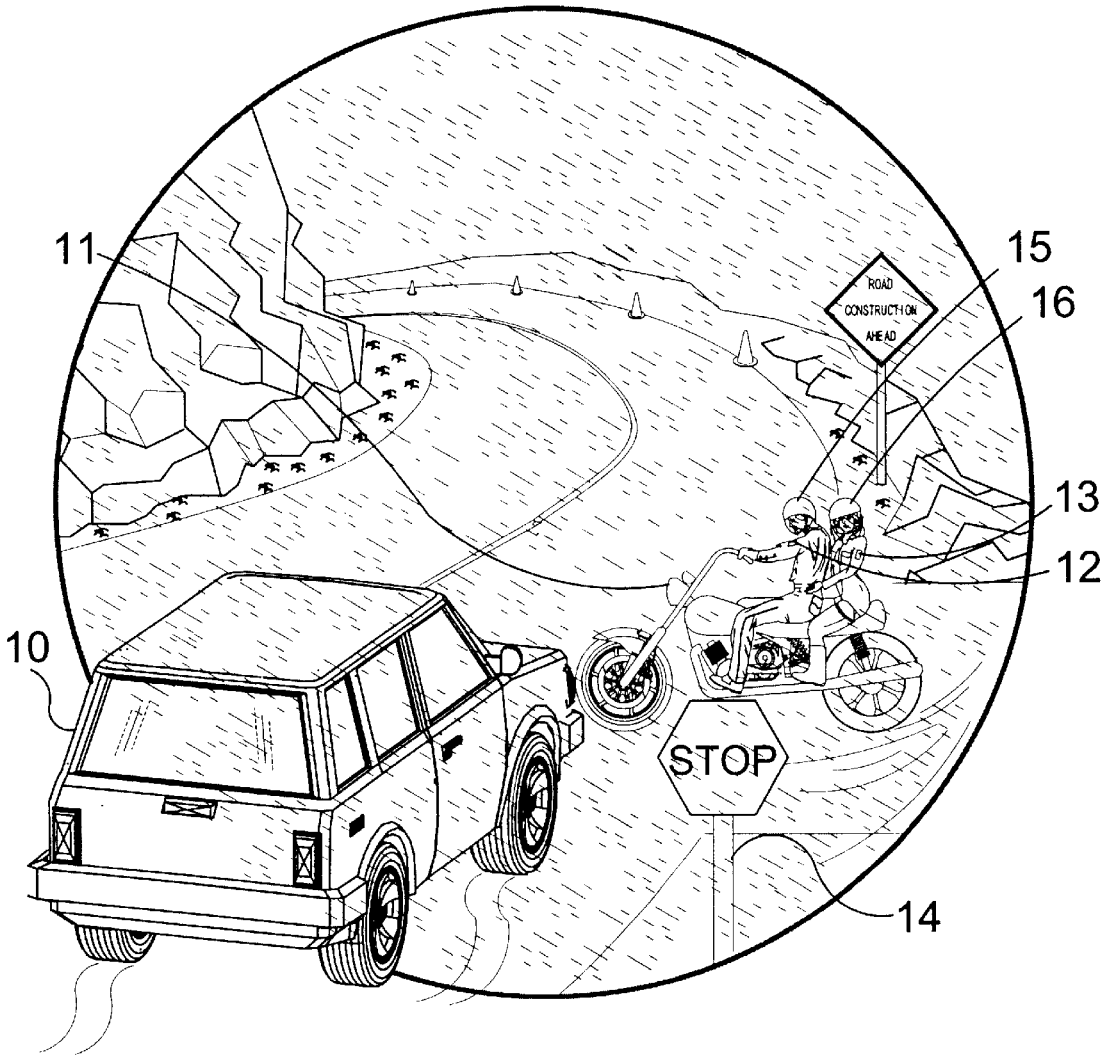
FIG. 1 is a pictorial view of the present invention in use.

Turning now descriptively to the drawings, in which similar reference characters denote similar elements throughout the several views, the figures illustrate the present invention. With regard to the reference numerals used, the following numbering is used throughout the various drawing figures.

10 Vehicle
11 Motorcycle entering road
12 Rider Down Emergency ID card (RDEIC)
13 Second RDEIC
14 Stop Sign
15 Motorcycle driver
16 Motorcycle passenger
17 Police vehicle
18 Emergency Medical Technician
19 Police Officer
20 Name and address field
21 Photo field
22 Data field
23 Removable cover
24 User shirt or jacket sleeve
25 Clear viewing plastic sleeve pocket
26 Removable cover attach strip
27 Belt RDEIC
28 Users belt
29 Clear viewing plastic belt cover
30 Cover side opening
31 Helmet RDEIC
32 Helmet attach strip
33 Removable helmet RDEIC cover
34 Helmet attach RDEIC band
35 Helmet attach clips
36 User helmet
37 Helmet RDEIC pocket
38 Alternate Emergency ID Card (EIDC)
39 Child rider
40 Electrically transferable data ID card
41 Bar code information storage field
42 User input
43 Physician input
44 Central Office
45 Database
46 Remote Unit
47 Display
48 Receiver
49 Transmitter
50 Remote Data Retrieval System
51 Scanner
52 User ID Card
53 Sleeve pocket stitches
54 Plastic sleeve access slot

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a pictorial view of the preferred embodiment of the present invention in use. Motorcycle driver 15 is wearing RDEIC 12, whereas motorcycle passenger 16 is wearing second RDEIC 13, both cards shown attached to the left sleeve of each rider. Each RDEIC 12, 13 can provide law enforcement and medical personnel with respective vital information in the event that an injured person is unconscious and unable to provide. In FIG. 1, vehicle 10 is depicted skidding through stop sign 14 as the same moment motorcycle 11 is entering the same intersection. The weather conditions are depicted raining with wet roads.

RDEIC's can also be used as an emergency card, ideal for anyone such as kids under the licensing age that carry no form of identification or personal information regarding name, address, blood type, allergies, or parental contact information.

Figure 2:
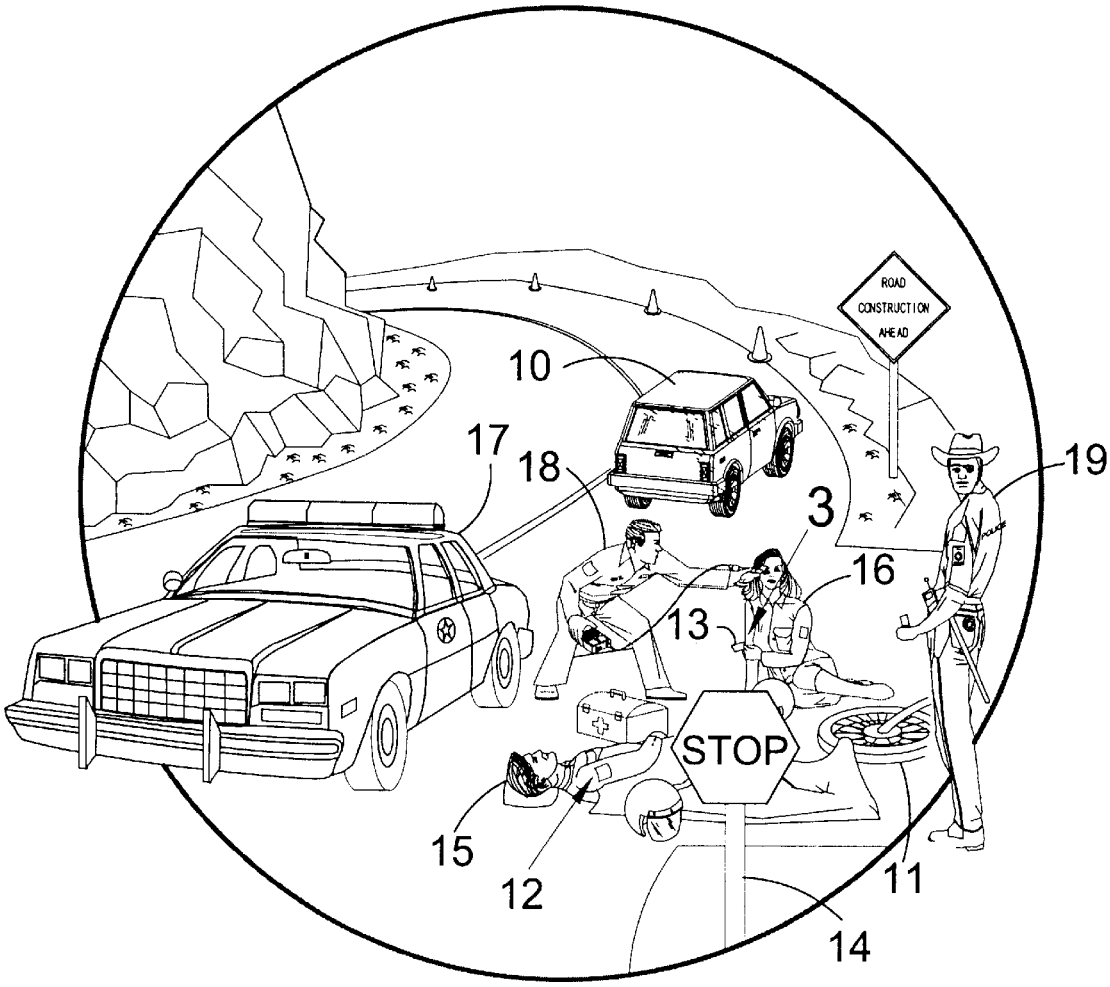
FIG. 2 is a pictorial view of a further sequence of events following FIG. 1 of the present invention in use.

FIG. 2 is a pictorial view of a further sequence of events following FIG. 1 showing the present invention in use. Depicted is police vehicle 17 at the scene of the accident, emergency medical technician 18 applying assistance to motorcycle passenger 16, motorcycle driver 15 lying comfortably after having been attended to, policeman 19 overseeing the accident, motorcycle 11 down, and vehicle 10 parked down the road from the intersection. RDEIC 12 can be seen on motorcycle driver 15 shoulders while second RDEIC 13 is in the hand of motorcycle passenger 16. In this depiction, each emergency rider down card has provided law enforcement and medical personnel with vital information. In the event of an injured person being unconscious, a RDEIC can save a life. A RDEIC is also an emergency card, ideal for anyone such as kids under the licensing age that carry no form of identification or personal information regarding name, address, blood type, allergies, diseases (such as diabetes etc.) parental or other emergency contact information. A RDEIC can be carried on a person in several ways, such as within a removable pouch attached to an arm sleeve by hook, loop fasteners or other means, or within the interior of a protective rider helmet or within an emergency ID attachment on an individual riders belt.

Figure 3:
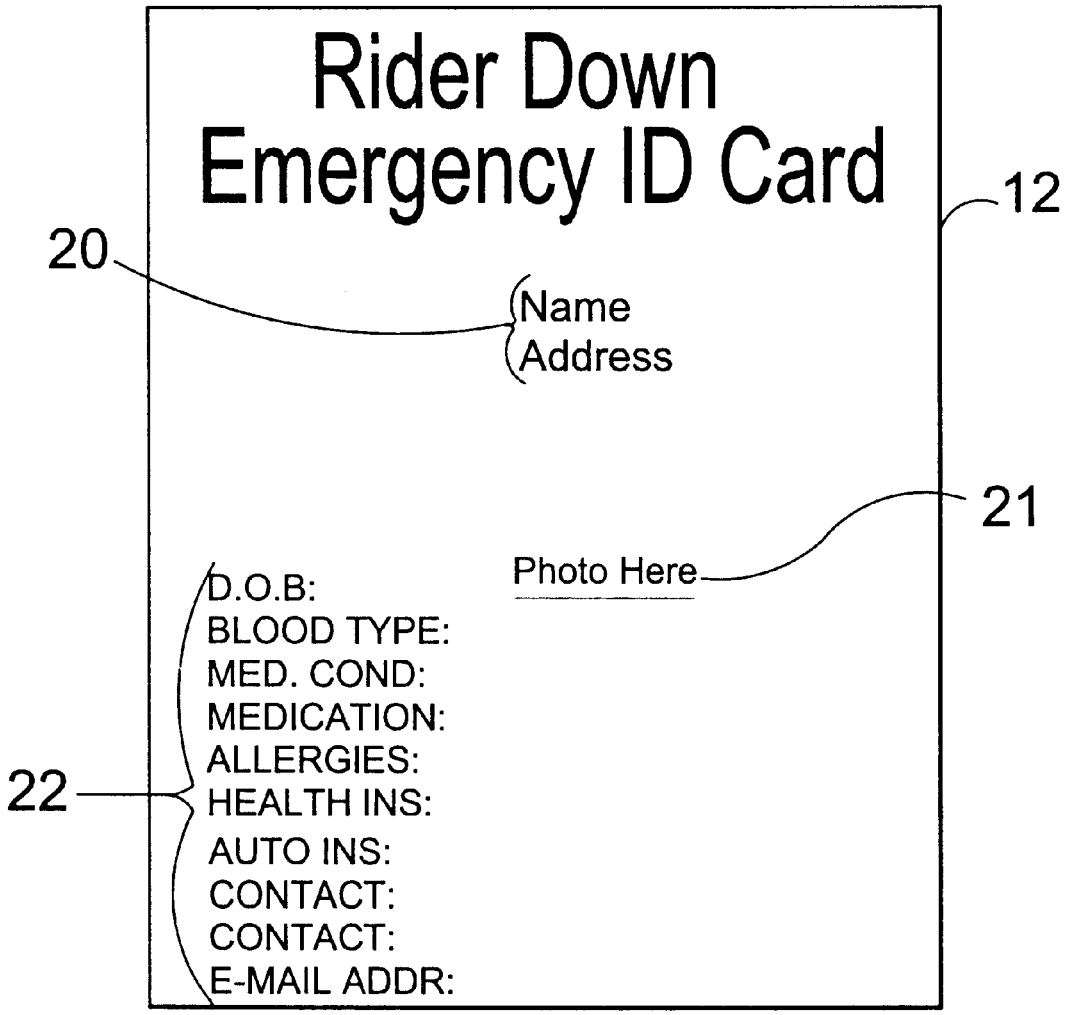
FIG. 3 is a front view a generic blank rider down emergency ID card (RDEIC) of the present invention.

FIG. 3 is a front view of generic blank RDEIC 12. RDEIC 12 contains information providing a means for an individual to carry personal and medical information unobtrusively by having the information on a card that can be displayed prominently or hidden under a patch. The card would be weather resistant and the user of RDEIC 12 would enter the pertinent information. Each RDEIC 12 would contain pertinent information in a name and address field 20, photo field 21 and a data field 22 as depicted in FIG. 3. Information contained can be, but not limited to, items such as:

1. User name
2. User address
3. Photo ID of user
4. Date of birth
5. Bloodtype
6. Any pertinent medical conditions such as diabetes, emphysema, etc.
7. Current medication(s)
8. Allergies
9. Health Insurance
10. Auto Insurance
11. Emergency Contact(s)
12. E-mail address Each RDEIC 12 would be supplied with a method for attachment. Examples for attachment can include, but are not limited to, a transparent sleeve having an adhesive layer on one side and/or mating hooks and loop members. One hook and loop member would be attached to the surface that will hold the card, such as a helmet or jacket, while the other is attached to the transparent sleeve. Additionally the transparent sleeve could have means for attaching a patch that would have one open side for removal of the ID card.

Figure 4:
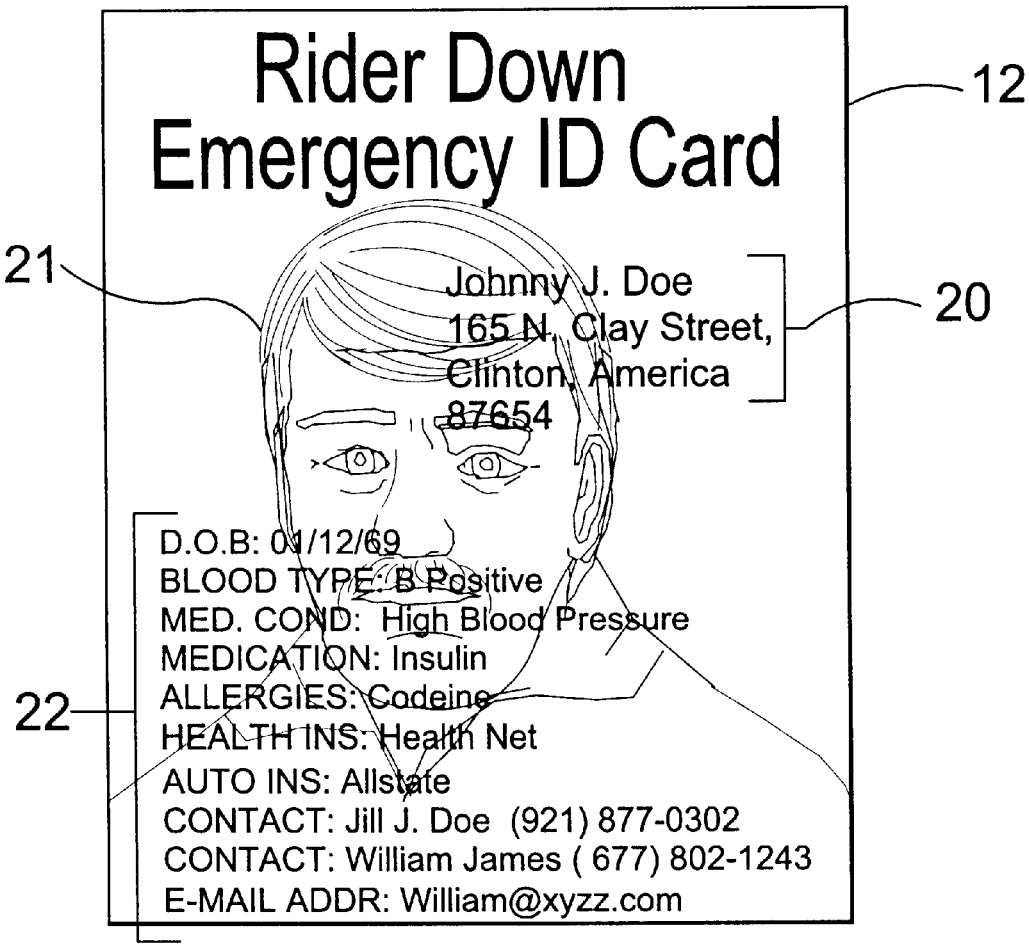
FIG. 4 is a front view of the RDEIC of the present invention with specific information placed therein.

FIG. 4 is a front view of RDEIC 12 with specific information placed therein. Shown is RDEIC 12 having personal and medical information supplied by the user. Name and address field 20, photo field 21 and a data field 22 all contain pertinent user data. Information contained within RDEIC 12 can be used to convey medical information to aid medical personal in treatment along with contact information whereby loved ones can be notified of the condition of the user. Each piece of information provided by the user would be voluntary. RDEIC 12 could be carried on a person in several ways as previously mentioned.

Figure 5:
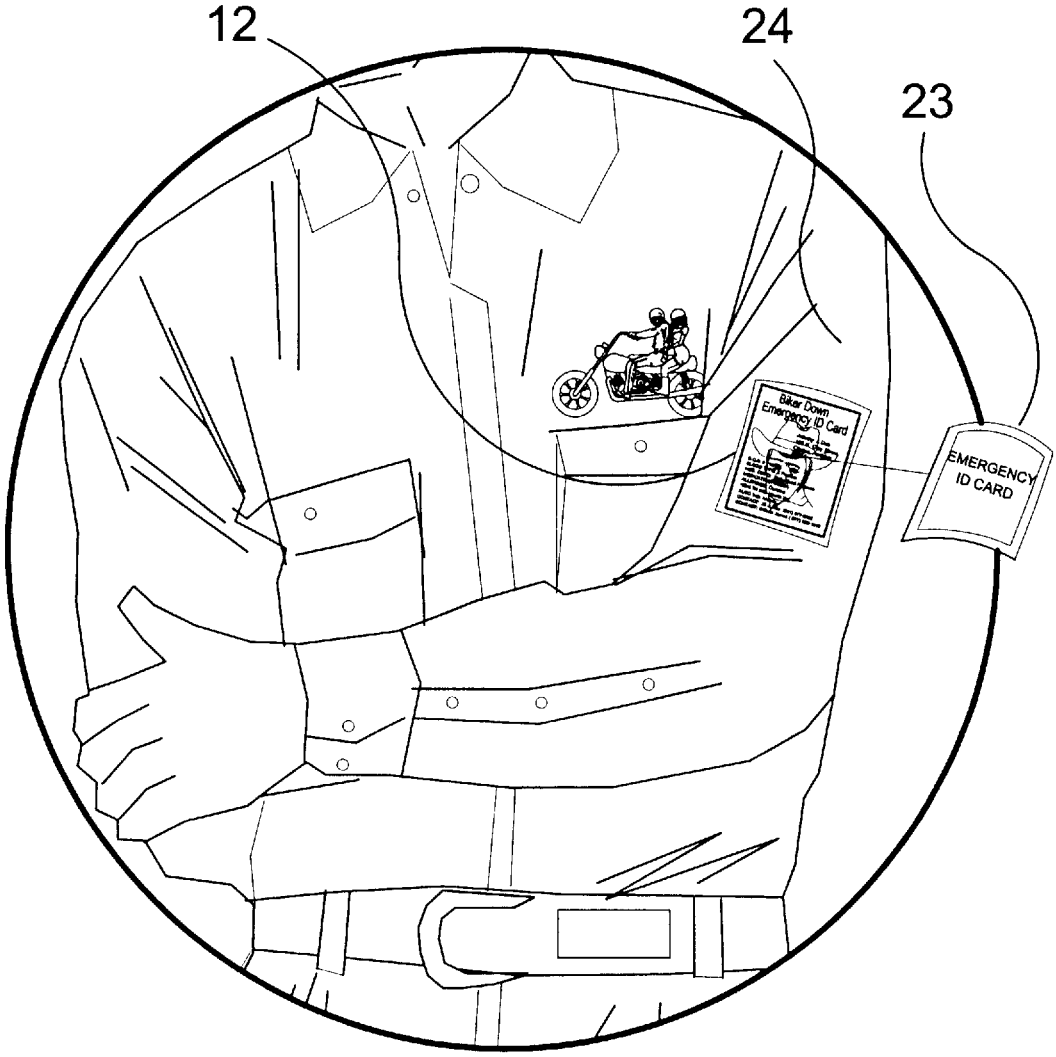
FIG. 5 is a pictorial view of the RDEIC attached to a users sleeve.

FIG. 5 is a pictorial view of RDEIC 12 attached to users sleeve 24 (jacket or shirt). Removable cover 23 can be made of, but not limited to, leather, vinyl material, cloth material, or it can be a clear viewing plastic cover. Although depicted as removable, removable cover 23 could also be sewn to the jacket or attached by mating hook and loop fastener strips attached to a user selected area such as a helmet or jacket mating with strips attached to the outer perimeter of the card pocket. Removable cover 23 can be covered by a decorative design such as patch or emblem, a company logo, etc. It also can contain descriptive wording such as "emergency id card".

Figure 6:
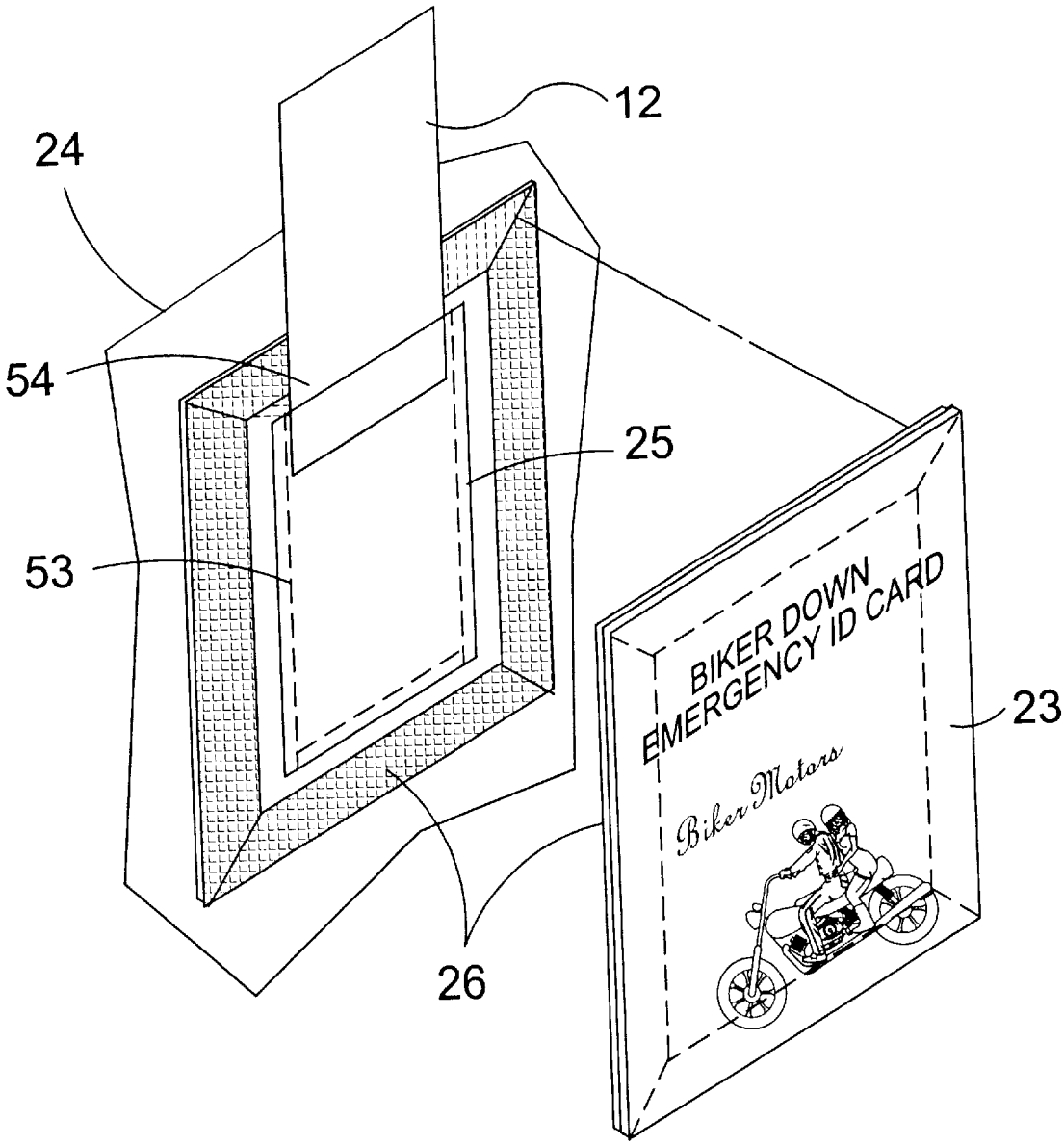
FIG. 6 is an exploded view of RDEIC attached to a users sleeve.

FIG. 6 is an exploded view of RDEIC 12 attached to users sleeve 24. In this particular embodiment of the present invention, RDEIC 12 slides into clear viewing plastic sleeve pocket 25 that is attached to sleeve 24. Removable cover attach strips 26 hold removable cover 23 to sleeve 24. In this manner RDEIC 12 can be readily removed from one article of clothing and placed in another. It should also be noted that a user can have more than one RDEIC 12 depending on his or her individual needs. Removable cover attach strips 26 can be made of Velcro® for example. Other means of attachment (not shown) can be simple snaps or hook and loop fastener strips. The outer portion of removable cover 23 could contain a decorative design such as patch or emblem, a company logo, etc. It also can contain descriptive wording such as "emergency id card". It should be noted that RDEIC 12 could also simply be placed into clear viewing plastic sleeve pocket 25, attached to sleeve 24 without need of removable cover 23. Sleeve 23 can also be designed with an overlap flap on its topside to further protect RDEIC 12. Clear viewing plastic sleeve pocket 25 is attached to a garment by sleeve pocket stitches 53, which allows RDEIC 12 to slide through plastic sleeve access slot 54.

Figure 7:
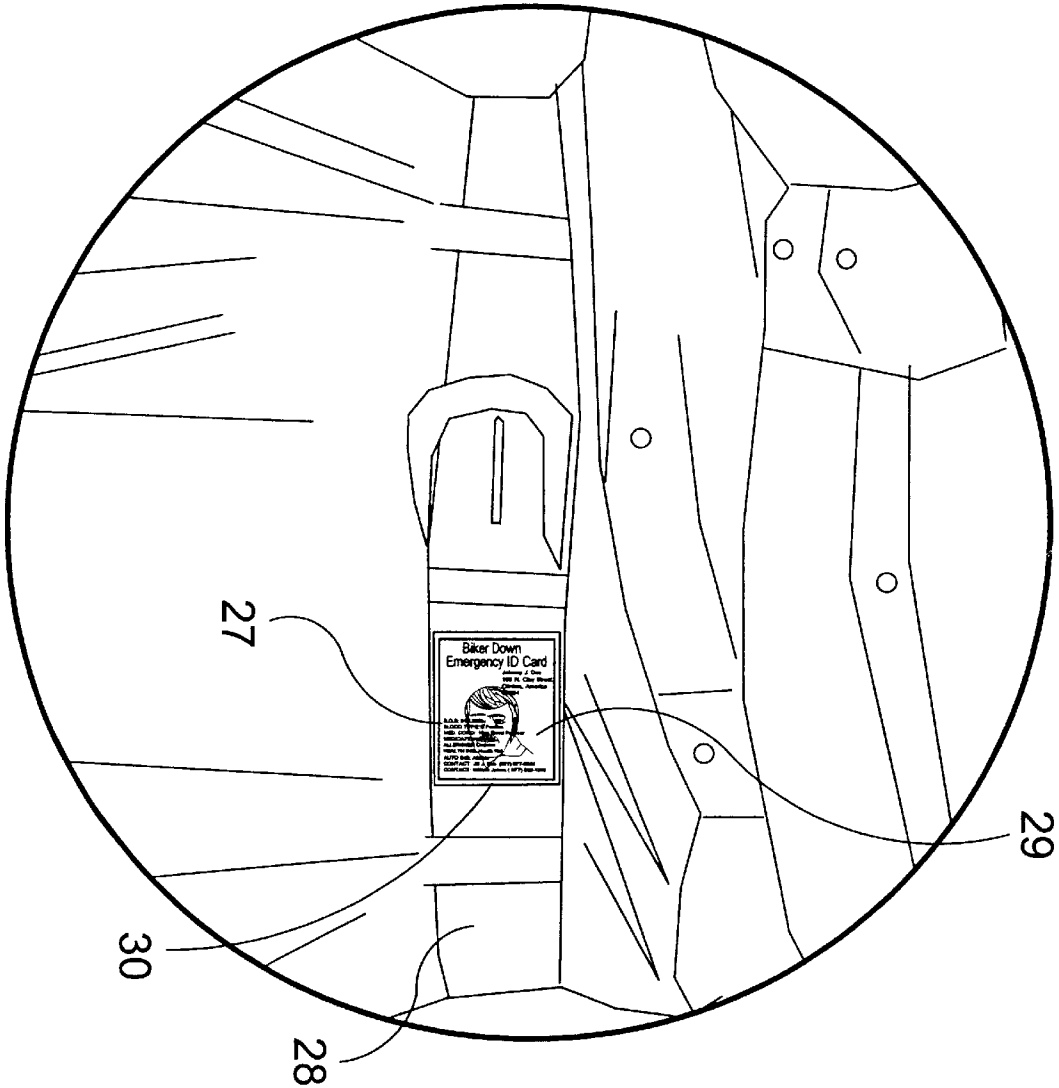
FIG. 7 is a pictorial view a belt RDEIC, in use, attached to a users belt, an alternate embodiment of the present invention.

FIG. 7 is a pictorial view belt RDEIC 27, in use, attached to users belt 28, an alternate embodiment of the present invention. Belt RDEIC 27 may be smaller in size than RDEIC 12, which can attach to a users sleeve. Belt RDEIC 27 is shown within a clear viewing plastic belt cover 29 which is depicted as sewn to belt 28 with cover side opening 30 for inserting or removing belt RDEIC 27. Other means of fastening clear viewing plastic belt cover 29 (not shown) would be a design using Velcrog, hook and loop fastener strips, etc. As shown in FIG. 6, the outer cover could also be made of leather or other materials, with or without a decorative design to cover belt RDEIC 27. The outer portion of the cover could contain, for example, a company logo and the words "emergency ID card".

Figure 8:
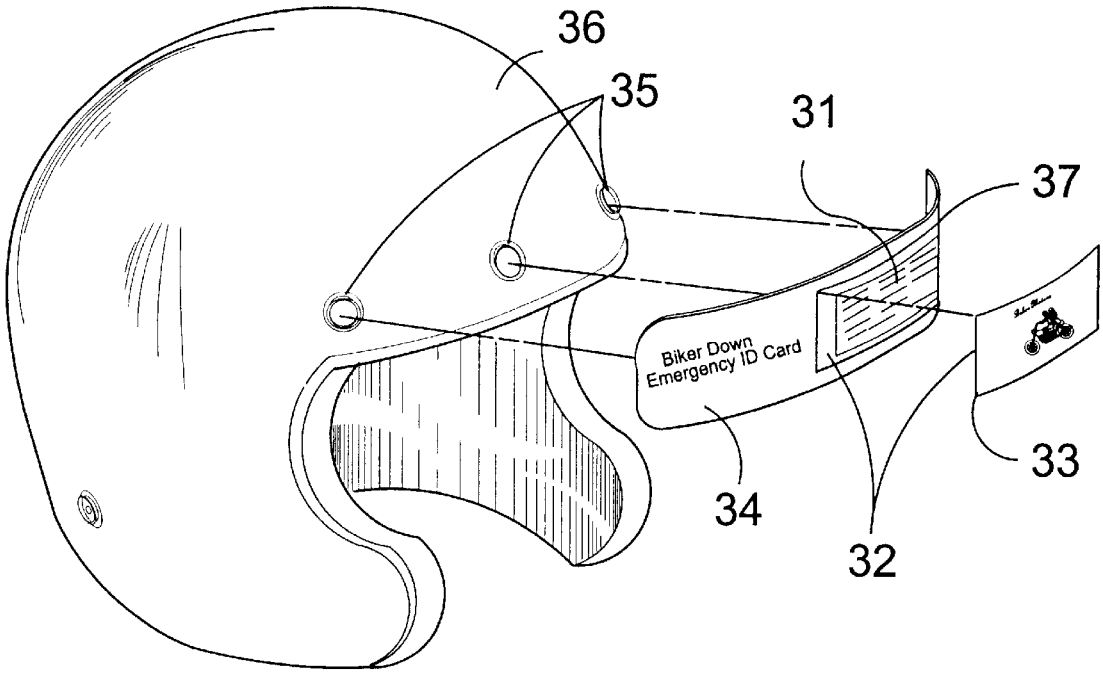
FIG. 8 is a pictorial view of a helmet RDEIC in use, attached to a user helmet, yet another alternate embodiment of the present invention.

FIG. 8 is a pictorial view of helmet RDEIC 31 in use, attached to user helmet 36, yet another alternate embodiment of the present invention. In this embodiment helmet 36 would contain helmet attach clips 35 as one example of attaching helmet RDEIC 31. Other means of attachment can readily be employed. Helmet RDEIC 31 would slide into helmet RDEIC pocket 37. Removable helmet RDEIC cover 33 would fit over helmet RDEIC pocket 37 and attach by means of helmet attach strips 32, which could be made out of Velcro® or other means. Helmet attach RDEIC band 34 would contain snaps (not shown) on its underside for snapping into helmet attach clips 35. It should be noted that although only one embodiment is shown attaching to a helmet, other embodiments attaching to other forms of headwear are easily derived from this embodiment. For example, helmet attach clips 35 could be replaced with Velcro® for attachment to a baseball type cloth hat.

Figure 9:
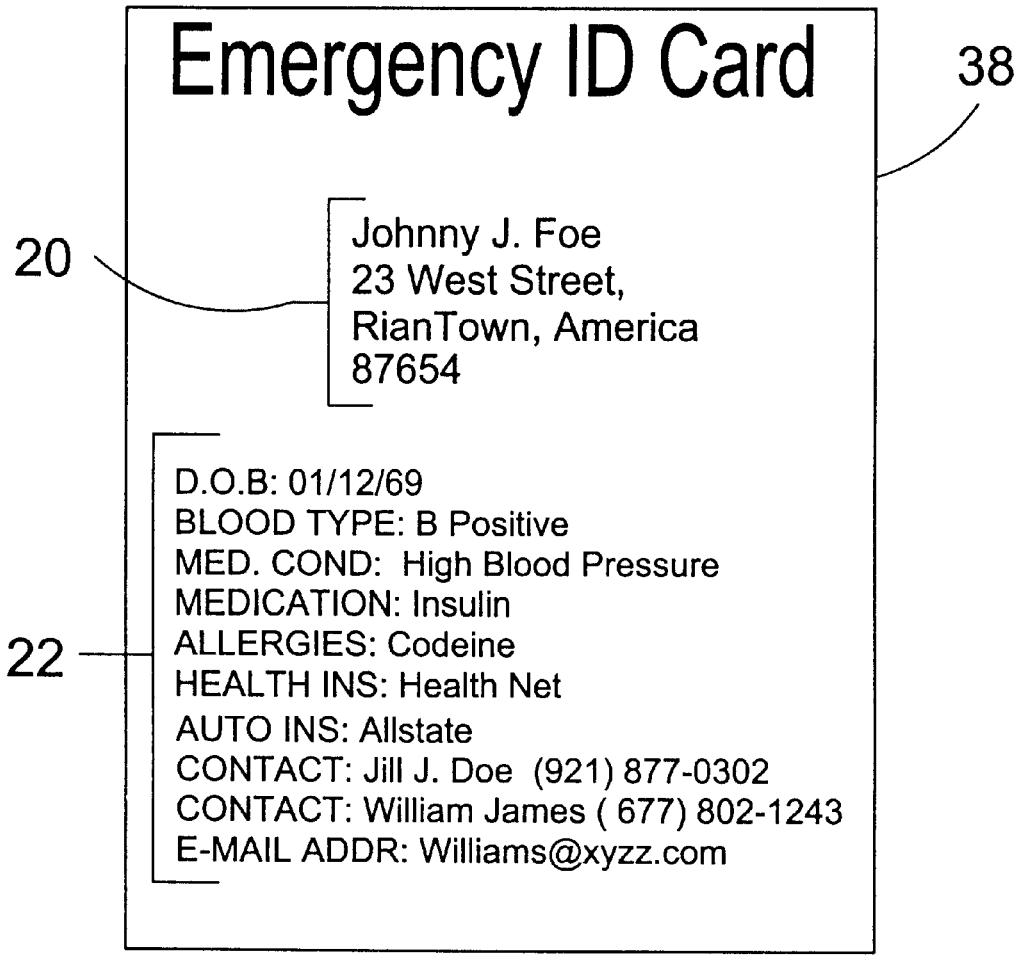
FIG. 9 is a front view of an alternate Emergency ID Card (EIDC), an embodiment of the present invention.

FIG. 9 is a front view of Alternate Emergency ID Card (EIDC) 38, an alternate embodiment of the present invention. FIG. 9 is similar to FIG. 4 with the exception that EIDC 38 is shown with no photo field (although a photo field can be employed) and it is titled "Emergency ID Card" for a more general use. EIDC 38 would have personal and medical information supplied by the user. Name and address field 20 and a data field 22 all contain pertinent user data. Information contained within. EIDC 38 could be carried on a person in several ways as previously mentioned. This alternate version of the present invention is an identification and emergency card that can be used by anyone and is ideal for kids. Kids below the licensing age often do not have any form of identification thereby hindering the efforts of police or medical providers. EIDC 38 can provide the vital information needed to assist them. EIDC 38 can be provided with a clear plastic pouch and hook and loop fastener strips that can be applied to the users clothing, cap or any place they choose to place them. It becomes a fun way to get a child to carry proper identification on their person.

Figure 10:
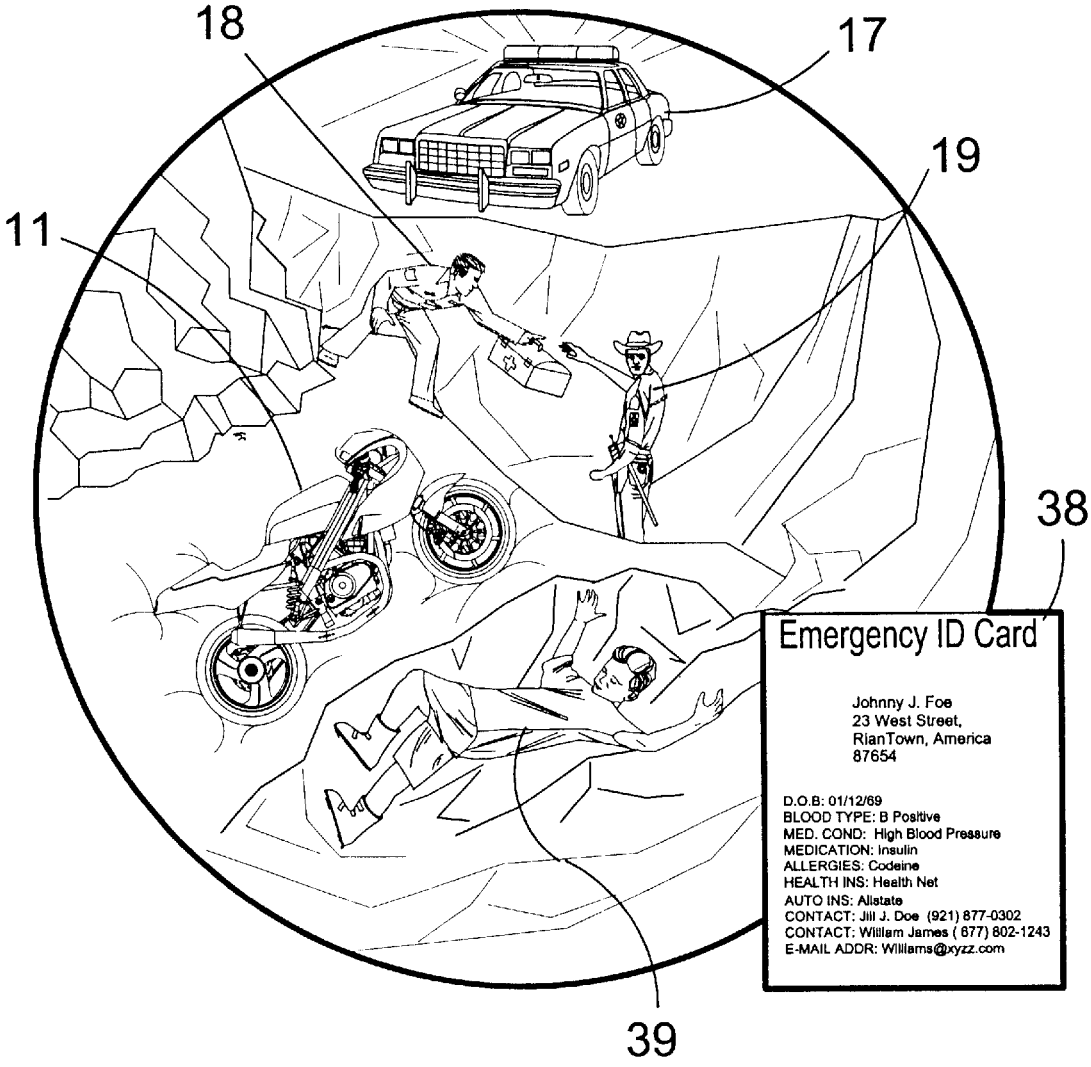
FIG. 10 is an illustrative view of the EIDC, an alternate embodiment of the present invention, in use by a child.

FIG. 10 is an illustrative view of EIDC 38, an alternate embodiment of the present invention, in use by child 39. In this depiction child 39 is down from an accident riding motorcycle 11. Police car 17 is at the scene; policeman 19 and emergency medical technician 18 are rendering service to child 39 based on information on EIDC 38. This alternate embodiment of the present invention is an identification and emergency card that can be used by anyone and is ideal for kids. EIDC 38 can provide the vital information needed to assist them emergency care providers.

Figure 11:
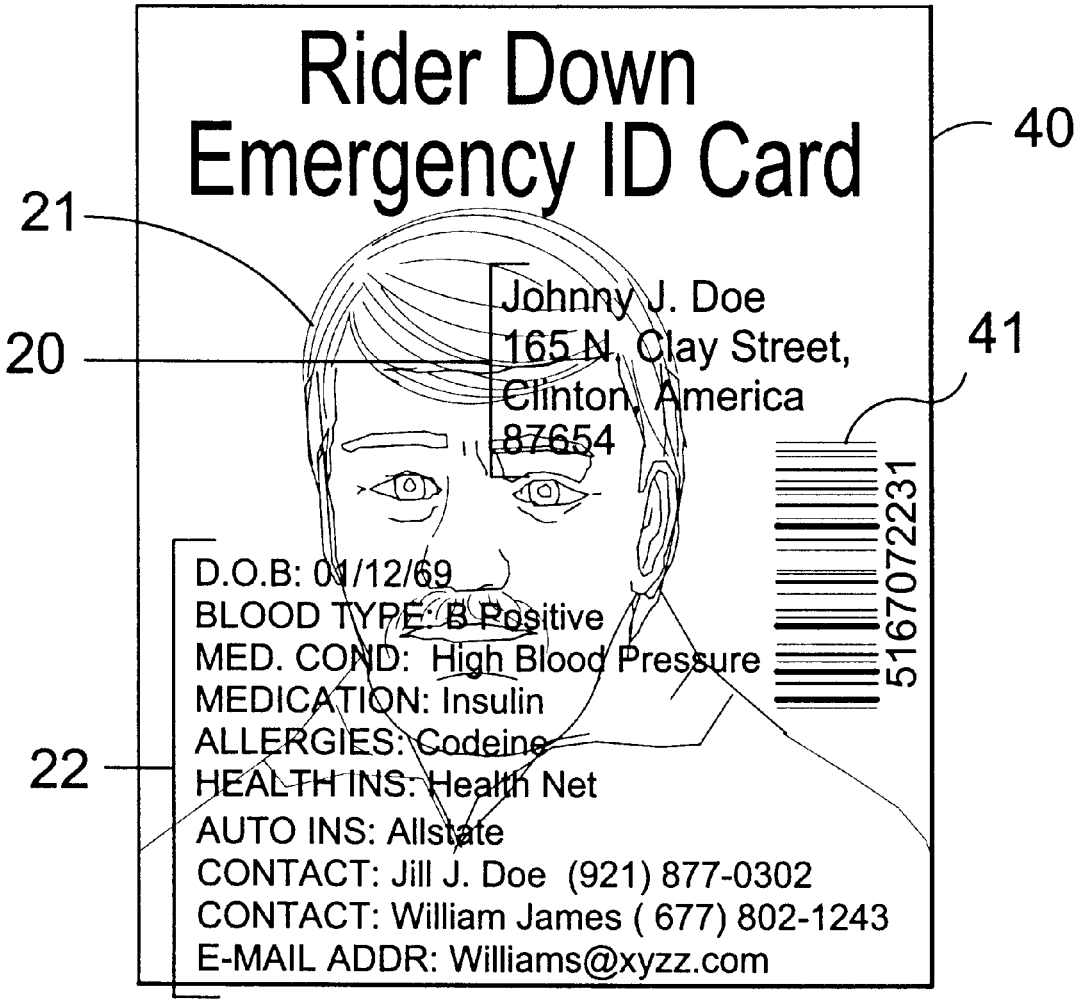
FIG. 11 is a front view of yet another alternate embodiment of the present invention, an electrically transferable data ID card, having means to configure date for electronic storage.

FIG. 11 is a front view of yet another alternate embodiment of the present invention, an electrically transferable data ID card 40, having means to configure date for electronic storage. The means for electronically storing data therein is shown as bar code information storage field 41. Bar code information storage field 41 would contain all of the pertinent data in name and address field 20 and data field 22 which could be retrieved by a compatible scanner or similar device thereby allowing emergency service workers access to more detailed information than may be provided in the text on electrically transferable data ID card 40. The data can be stored on the card itself using a scan-readable data field such as bar code information storage field 41 or other means such as an electronic chip which could also store and transfer image data such as contained in photo field 21. Data may also be stored in a database with the card having a pin number (not shown) that when scanned will access the database and all pertinent information entered therein. The user's physician can update any changes regarding the patient's needs. Not only can the database provide information about the user's physician such as telephone numbers and the like, but the physician may update the database when not available to provide the phone number for the physician on call for his cases so that medical information and contacts may always be up to date.

Figure 12:
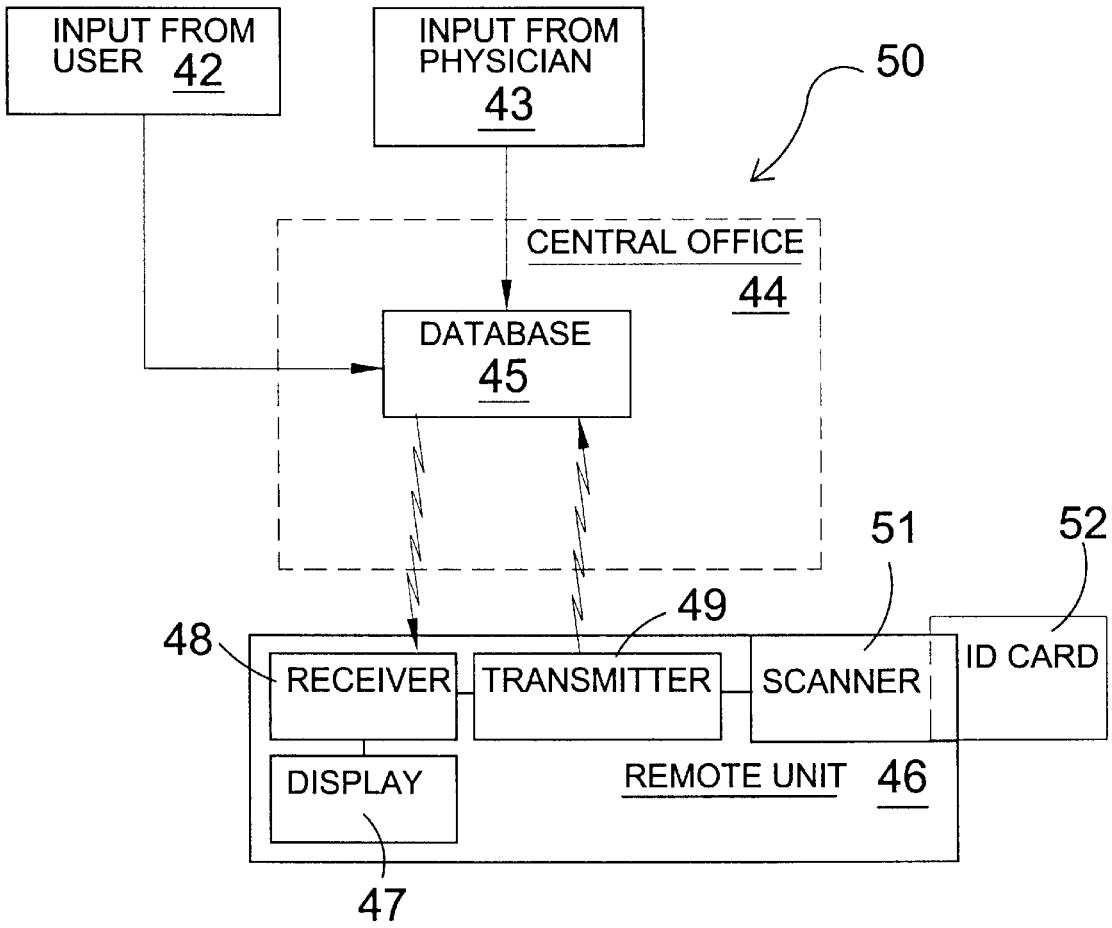
FIG. 12 is a block diagram of a possible configuration of a remote data retrieval system.

FIG. 12 is a block diagram of a possible configuration of a remote data retrieval system 50. In the configuration shown, data is entered by with user input 42 or physician input 43. A database 45 is maintained at a central office 44 location. When an emergency service worker scans emergency ID card 52 into remote unit 46. Transmitter 49 can send data to central office 44. Data sent from central office 44 is gathered by receiver 48 and displayed on display 47 onsite viewing by emergency medical personnel. Database 45 may be updated by the user or by a physician as necessary. ID card 52 can contain a scan-ready information field (such as bar code or an electronic chip) for information storage. The ability to scan data on an emergency identification card could also be a valuable tool in the case of an accident where the emergency identification card is partially damaged. An internal card electronic chip would especially be immune to damage from scratches, foreign substance, or limited heat.

I claim:

1. In combination with a garment having a flat section, an improvement comprising:

a transparent shield fastened to the flat section;

said transparent shield having an access slot to receive an emergency ID card;

a first hook and loop strip surrounding said transparent shield; and an emergency cover having a second hook and loop strip on its back side to fasten to the first hook and loop strip;

thereby enabling a rescuer to quickly see the emergency cover on a victim, enable the rapid removal of the emergency cover, and read the protected emergency ID card.

2. The improvement of claim 1, wherein the emergency cover has an insignia.

3. The improvement of claim 2, wherein the emergency ID card further comprises electronically scannable data.

* * * * *